US012329279B2

(12) United States Patent
Chen et al.

(10) Patent No.: US 12,329,279 B2
(45) Date of Patent: Jun. 17, 2025

(54) FURNITURE SYSTEM AND FURNITURE ASSEMBLY THEREOF

(71) Applicants: King Slide Works Co., Ltd., Kaohsiung (TW); King Slide Technology Co., Ltd., Kaohsiung (TW)

(72) Inventors: Ken-Ching Chen, Kaohsiung (TW); Fang-Cheng Su, Kaohsiung (TW); Yue-Hua Tang, Kaohsiung (TW); Chun-Chiang Wang, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 154 days.

(21) Appl. No.: 18/347,045

(22) Filed: Jul. 5, 2023

(65) Prior Publication Data

US 2024/0298795 A1 Sep. 12, 2024

(30) Foreign Application Priority Data

Mar. 6, 2023 (TW) ..... 112108390

(51) Int. Cl.
*A47B 88/938* (2017.01)

(52) U.S. Cl.
CPC ..... *A47B 88/938* (2017.01); *A47B 2088/939* (2017.01); *A47B 2088/94* (2017.01)

(58) Field of Classification Search
CPC ... A47B 88/925; A47B 88/931; A47B 88/938; A47B 2088/0007; A47B 2088/0033; A47B 2088/0088; A47B 2088/0092; A47B 2088/0096; A47B 2088/939; A47B 2088/94
See application file for complete search history.

(56) References Cited

U.S. PATENT DOCUMENTS

| | | | | |
|---|---|---|---|---|
| 5,076,652 | A | 12/1991 | Lautenschlager | |
| 9,161,624 | B2 | 10/2015 | Haemmerle | |
| 11,122,895 | B2 | 9/2021 | Kampl | |
| 11,219,312 | B2 | 1/2022 | Kampl | |
| 2011/0163647 | A1* | 7/2011 | Hartl | A47B 88/956 312/334.7 |
| 2013/0293079 | A1* | 11/2013 | Haemmerle | A47B 88/40 312/334.8 |
| 2018/0177297 | A1* | 6/2018 | Held | A47B 88/931 |

(Continued)

FOREIGN PATENT DOCUMENTS

WO WO-2013185154 A2 * 12/2013 ..... A47B 88/0085

*Primary Examiner* — Andrew Roersma
(74) *Attorney, Agent, or Firm* — Best & Flanagan LLP

(57) ABSTRACT

A furniture assembly includes a panel and a fitting member. The panel is arranged with a first connecting feature. The fitting member is arranged with a second connecting feature configured to be detachably connected with the first connecting feature. The second connecting feature is formed with a space. A guiding section and an engaging section adjacent to the guiding section are arranged in the space. During a process of the fitting member being mounted to the panel, the space is configured to allow the first connecting feature to enter therein, and the guiding section is configured to guide the first connecting feature to be engaged with the engaging section, in order to detachably connect the fitting member with the panel. The present invention also provides a furniture system.

8 Claims, 9 Drawing Sheets

(56) References Cited

U.S. PATENT DOCUMENTS

| | | | | |
|---|---|---|---|---|
| 2020/0315347 | A1* | 10/2020 | Kampl | A47B 88/931 |
| 2024/0000230 | A1* | 1/2024 | Chen | A47B 47/0075 |
| 2024/0000231 | A1* | 1/2024 | Chen | F16B 12/22 |
| 2024/0003370 | A1* | 1/2024 | Chen | F16B 12/38 |
| 2024/0301904 | A1* | 9/2024 | Chen | F16B 12/02 |

* cited by examiner

FURNITURE SYSTEM AND FURNITURE ASSEMBLY THEREOF

BACKGROUND OF THE INVENTION

1. Field of the Invention

The present invention relates to a furniture system, and more particularly, to a furniture system and its furniture assembly having a fitting member to be installed according to user's requirements.

2. Description of the Prior Art

U.S. Pat. No. 11,219,312 B2 discloses a rail bar for a drawer. The rail bar is necessary to be arranged with a spring element, and the spring element is configured to apply an elastic force to a length adjustment element of the rail bar. One end of the rail bar is connected to a wall element (such as a front panel or a rear wall of the drawer).

U.S. Pat. No. 11,122,895 B2 discloses a railing strut for a drawer. The railing strut is necessary to be arranged with two locking elements and a movable actuating element at an end region. A user can apply a force to the actuating element to drive the locking elements.

However, in order to meet diverse requirements of the market, it is important to develop different products.

SUMMARY OF THE INVENTION

The present invention provides a furniture system and its furniture assembly having a fitting member to be installed according to user's requirements.

According to an embodiment of the present invention, a furniture assembly comprises a first panel and a fitting member. The first panel is arranged with a first connecting feature. The fitting member is arranged with a second connecting feature configured to be detachably connected with the first connecting feature. One of the first connecting feature and the second connecting feature is formed with a space, and a guiding section and an engaging section adjacent to the guiding section are arranged in the space. The other one of the first connecting feature and the second connecting feature comprises a head part. During a process of the fitting member being mounted to the first panel, the space is configured to allow the head part to enter therein, and the guiding section is configured to guide the head part to be engaged with the engaging section, in order to detachably connect the fitting member to the first panel.

According to another embodiment of the present invention, a furniture system comprises a bottom plate, a first side wall, a second side wall, a first panel, a second panel and a fitting member. The first side wall and the second side wall are arranged at left and right sides of the bottom plate respectively. The first panel and the second panel are arranged at front and rear sides of the bottom plate respectively, and the first panel is arranged with a first connecting feature. The fitting member comprises a first part and a second part. The fitting member is arranged with a second connecting feature located adjacent to the first part, and the second connecting feature is configured to be detachably connected with the first connecting feature. One of the first connecting feature and the second connecting feature is formed with a space, and a guiding section and an engaging section adjacent to the guiding section are arranged in the space. The other one of the first connecting feature and the second connecting feature comprises a head part. During a process of the fitting member being mounted to the first panel, the space is configured to allow the head part to enter therein, and the guiding section is configured to guide the head part to be engaged with the engaging section. The second panel comprises a first mounting feature, and the fitting member is further arranged with a second mounting feature configured to be detachably connected with the first mounting feature. One of the first mounting feature and the second mounting feature is an elastic element.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
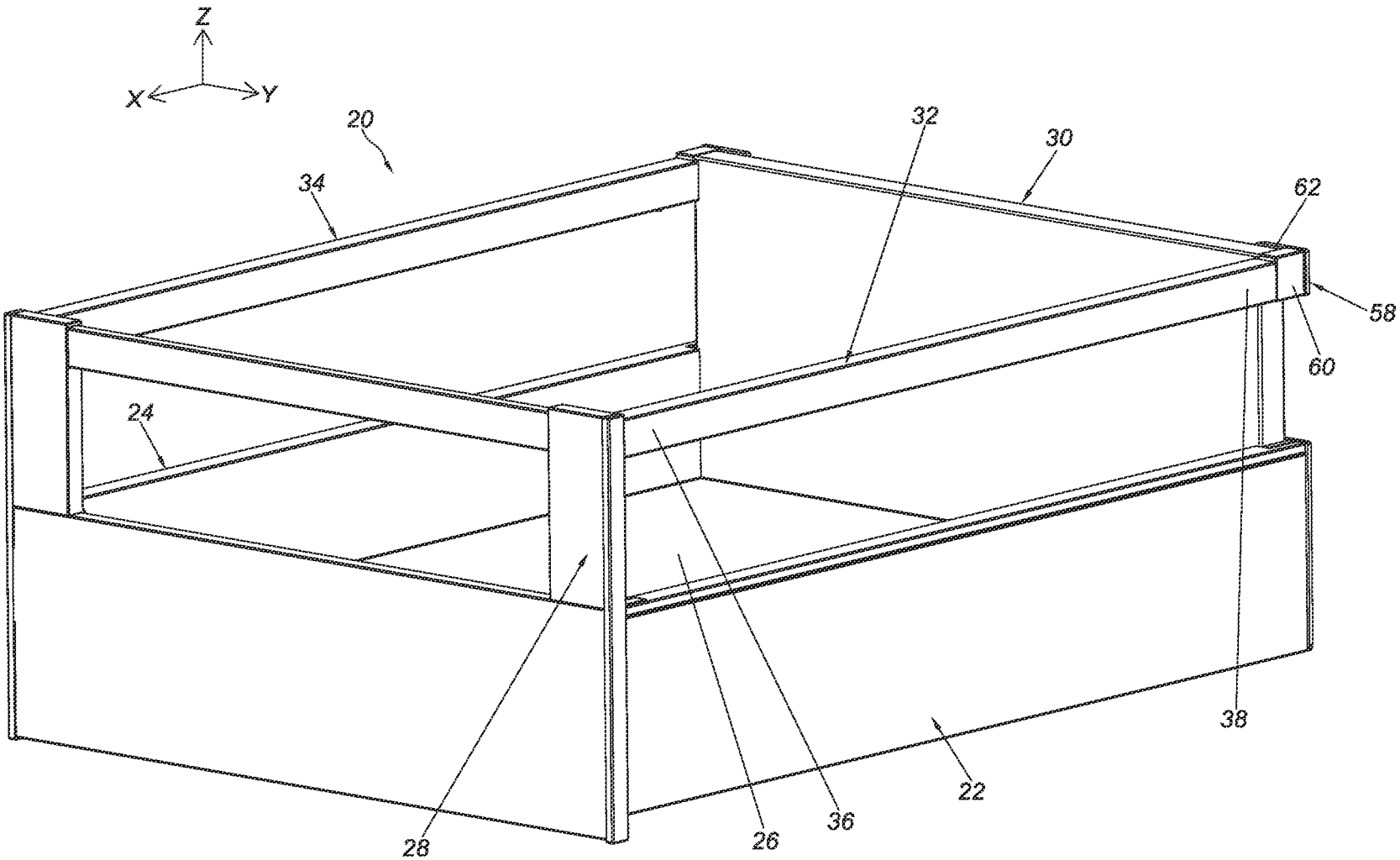
FIG. 1 is a diagram showing a furniture system in a first viewing angle according to an embodiment of the present invention.
Figure 2:
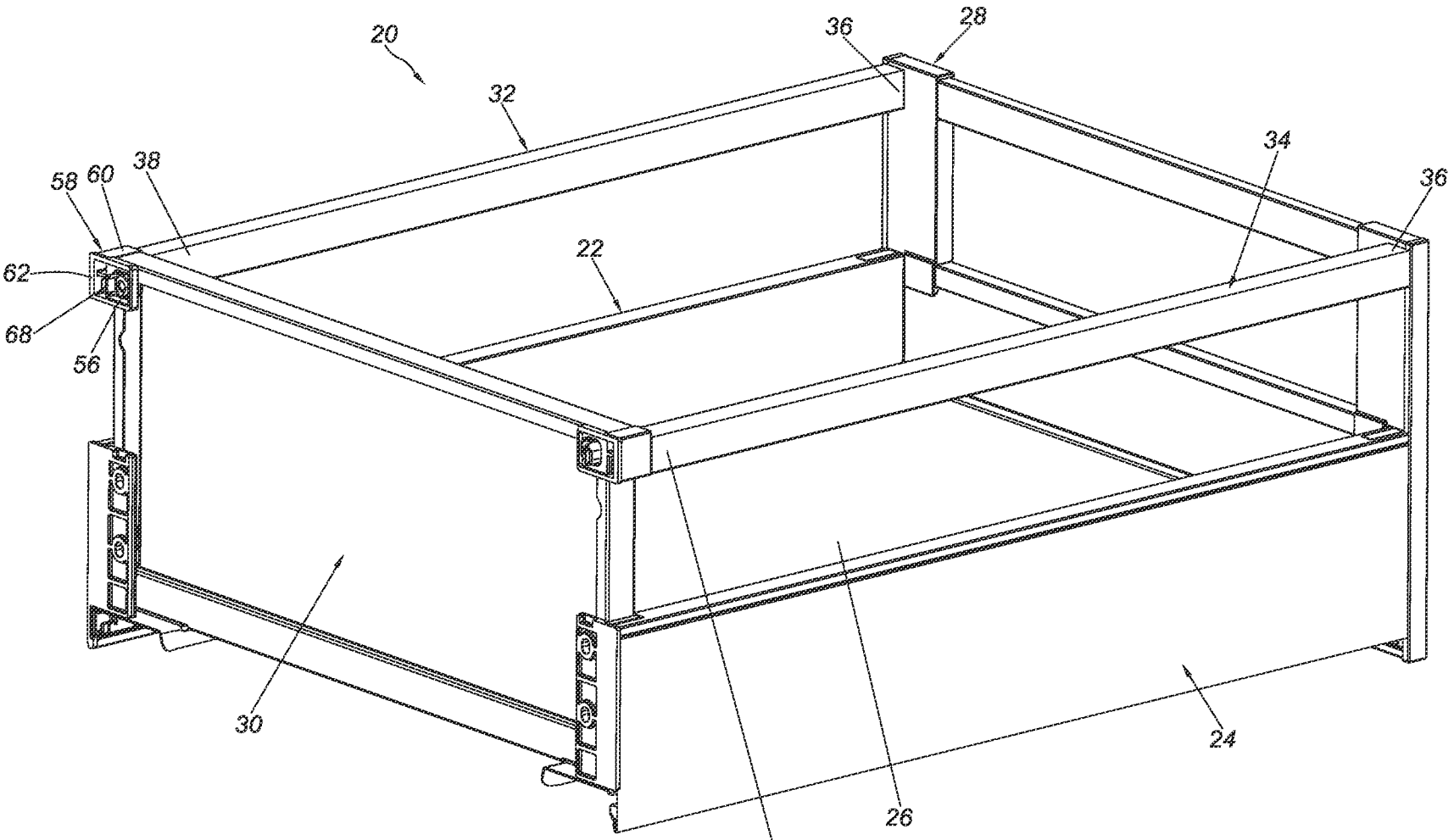
FIG. 2 is a diagram showing the furniture system in a second viewing angle according to the embodiment of the present invention.

As shown in FIG. 1 and FIG. 2, a furniture system 20 includes a first side wall 22, a second side wall 24, a bottom plate 26, a first panel 28 and a second panel 30 according to an embodiment of the present invention. In the present embodiment, the furniture system 20 is a drawer, but the present invention is not limited thereto.

The first side wall 22 and the second side wall 24 are arranged at a left side and a right side of the bottom plate 26 respectively. The left and right sides are only for illustration to facilitate understanding of relative positions, that is, the left and right sides are interchangeable, and are not intended to limit the specific positions. On the other hand, the first panel 28 and the second panel 30 are arranged at a front side and a rear side of the bottom plate 26 respectively. For example, the first panel 28 is a front panel, and the second panel 30 is a rear panel (or back panel), but the present invention is not limited thereto.

The first side wall 22, the second side wall 24, the bottom plate 26, the first panel 28 and the second panel 30 together define an accommodating space for accommodating objects.

In the present embodiment, the X-axis is a length direction of the furniture system 20, the Y-axis is a width direction of the furniture system 20, and the Z-axis is a height direction of the furniture system 20. The length direction, the width direction and the height direction are perpendicular to each other. In addition, left and right sides of the furniture system 20 have substantially identical structural arrangement. In response to user requirements, the left side and the right side of the furniture system 20 can be respectively arranged with a first fitting member 32 and a second fitting member 34 to increase heights of the left and right sides of the furniture system 20, so as to match heights of the first panel 28 and the second panel 30.

In the following description, only the first fitting member 32 is illustrated since the second fitting member 34 is similar to the first fitting member 32. Preferably, the first fitting member 32 can be a rod or a wall. In the present embodiment, the first fitting member 32 is a rod, but the present invention is not limited thereto. In addition, a length of the rod is substantially identical to a length of the first side wall 22. The first panel 28 and the first fitting member 32 together form a furniture assembly. Preferably, the furniture assembly further comprises the second panel 30. The first fitting member 32 is configured to be detachably connected to the first panel 28 and the second panel 30.

Figure 3:
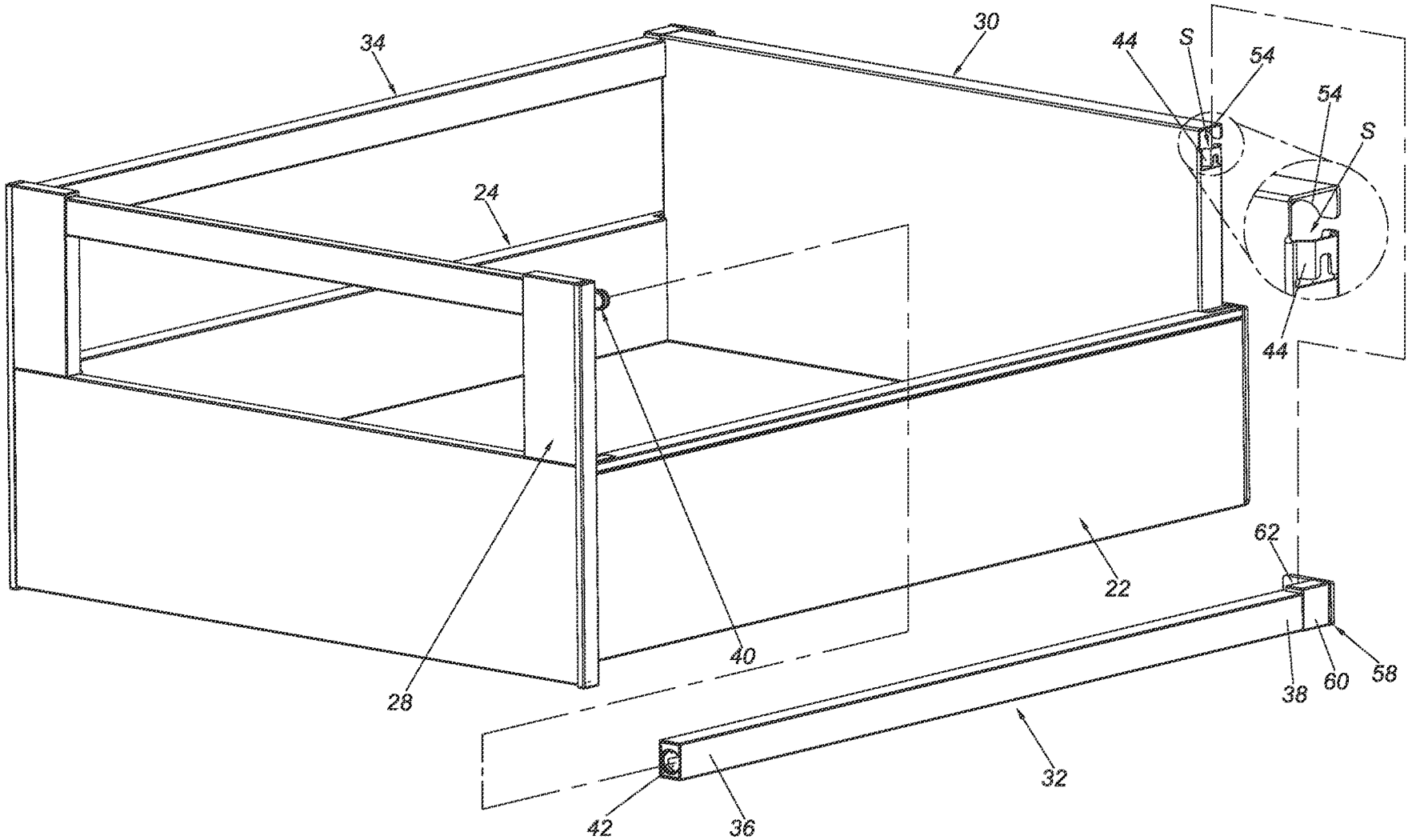
FIG. 3 is a diagram showing a fitting member of the furniture system being detached from a first panel and a second panel of the furniture system according to the embodiment of the present invention.

As shown in FIG. 3, the first panel 28 is arranged with a first connecting feature 40, and the fitting member 32 comprises a first part 36 and a second part 38, such as a front part and a rear part, located at opposite positions, but the present invention is not limited thereto. The first fitting member 32 is arranged with a second connecting feature 42 configured to be detachably connected with the first connecting feature 40 of the first panel 28.

Preferably, the second connecting feature 42 is located adjacent to the first part 36 of the first fitting member 32.

Preferably, the second panel 30 is arranged with a first engaging structure 44, and the first fitting member 32 is further arranged with a second engaging structure 46 (please also refer to FIG. 4) located adjacent to the second part 38 of the first fitting member 32. The second engaging structure 46 is configured to be detachably connected with the first engaging structure 44.

Preferably, one of the first engaging structure 44 and the second engaging structure 46 is a protrusion. In the present embodiment, the first engaging structure 44 is a protrusion, and the protrusion defines a mounting space S (as shown in FIG. 3). The other one of the first engaging structure 44 and the second engaging structure 46 is an extension piece. In the present embodiment, the second engaging structure 46 is an extension piece (please also refer to FIG. 4), and the extension piece is configured to be mounted (for example, inserted) into the mounting space S, such that the extension piece and the protrusion support or abut against each other.

Figure 4:
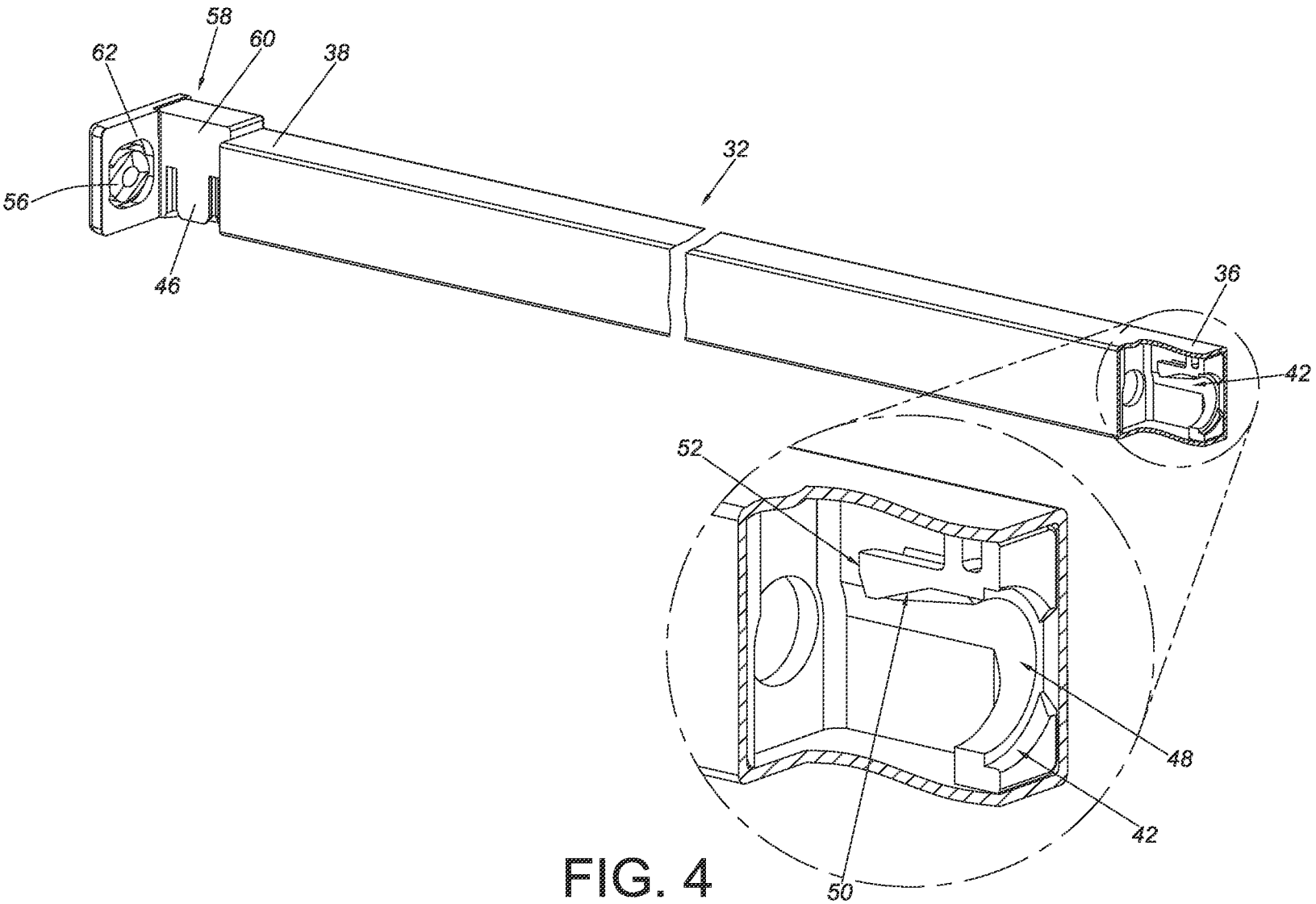
FIG. 4 is a partial cross-sectional view of the fitting member according to the embodiment of the present invention.

As shown in FIG. 3 and FIG. 4, one of the first connecting feature 40 and the second connecting feature 42 is formed with a space 48, and the space 48 is arranged with a guiding section 50 and an engaging section 52 adjacent to the guiding section 50 therein. Preferably, the guiding section 50 has an inclined surface or an arc surface (as shown in FIG. 4).

Preferably, the second panel 30 further comprises a first mounting feature 54 (as shown in FIG. 3), and the first fitting member 32 is further arranged with a second mounting feature 56 (as shown in FIG. 4) configured to be detachably connected with the first mounting feature 54.

Preferably, the first fitting member 32 is further arranged with an auxiliary member 58 adjacent to the second part 38. The auxiliary member 58 comprises a first auxiliary part 60 and a second auxiliary part 62 bent relative to the first auxiliary part 60. In the present embodiment, the first auxiliary part 60 and the second auxiliary part 62 are substantially perpendicularly connected to each other, but the present invention is not limited thereto.

Preferably, the second engaging structure 46 is arranged on the first auxiliary part 60 of the auxiliary member 58, and the second mounting feature 56 is arranged on the second auxiliary part 62 of the auxiliary member 58 (as shown in FIG. 4).

Figure 5:
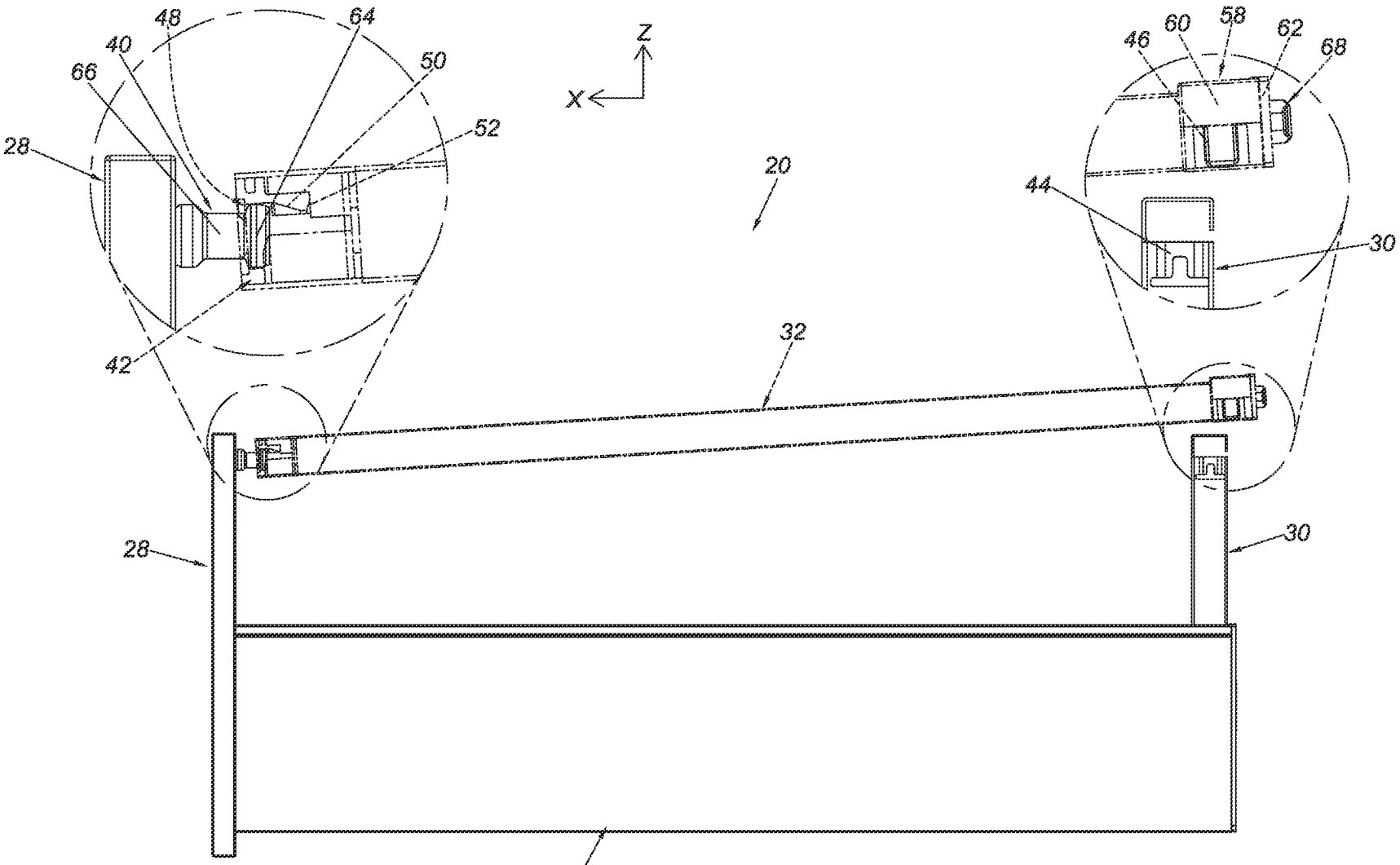
FIG. 5 is a diagram showing a first process of mounting the fitting member to the first panel and the second panel according to the embodiment of the present invention.

As shown in FIG. 5, the first side wall 22 is connected between the first panel 28 and the second panel 30. The other one of the first connecting feature 40 and the second connecting feature 42 comprises a head part 64 and an extension part 66. In the present embodiment, the first connecting feature 40 comprises the head part 64 and the extension part 66. The extension part 66 is connected between the head part 64 and the first panel 28. On the other hand, the second connecting feature 42 has the space 48, the guiding section 50 and the engaging section 52.

Figure 6:
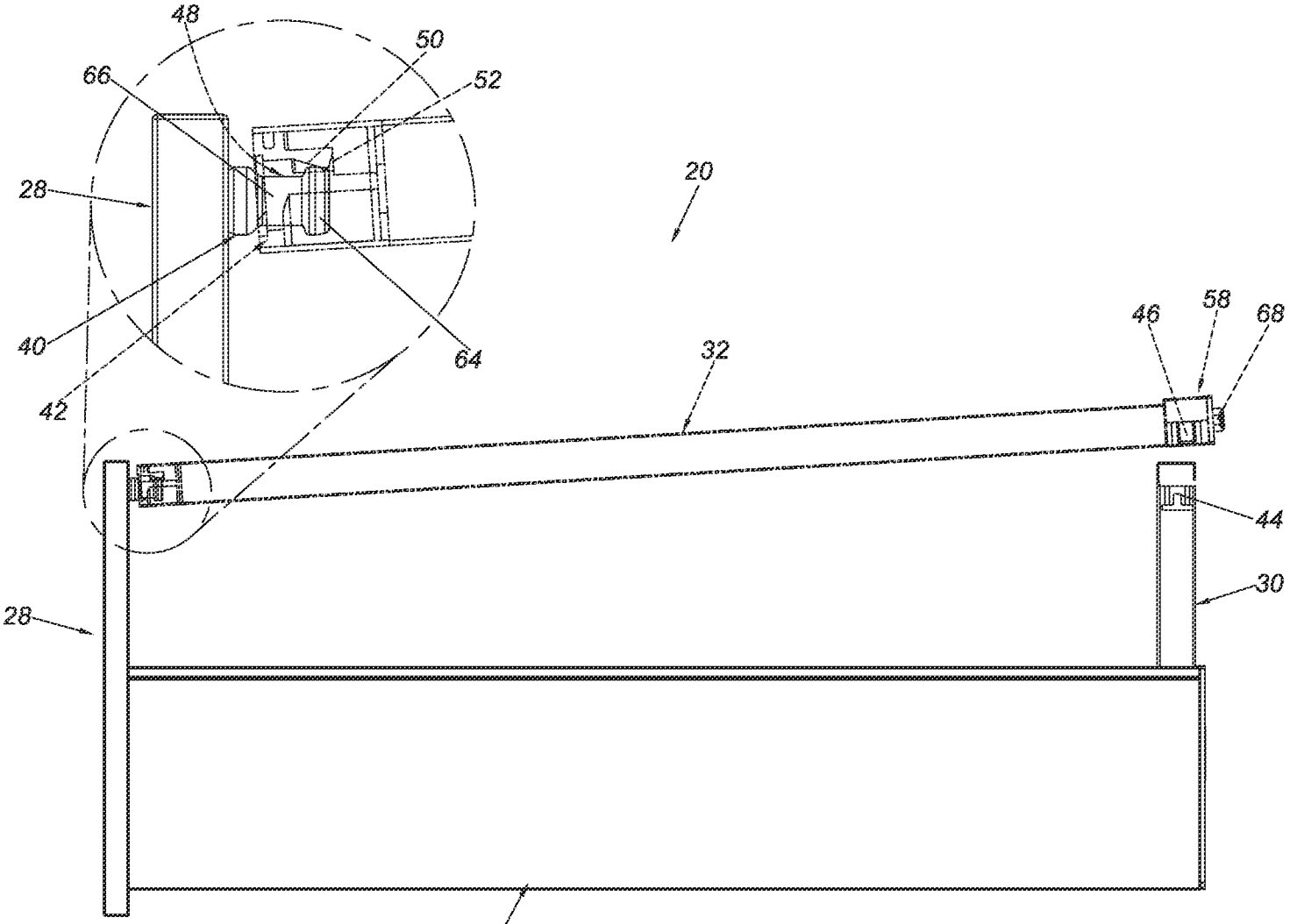
FIG. 6 is a diagram showing a second process of mounting the fitting member to the first panel and the second panel according to the embodiment of the present invention.
Figure 7:
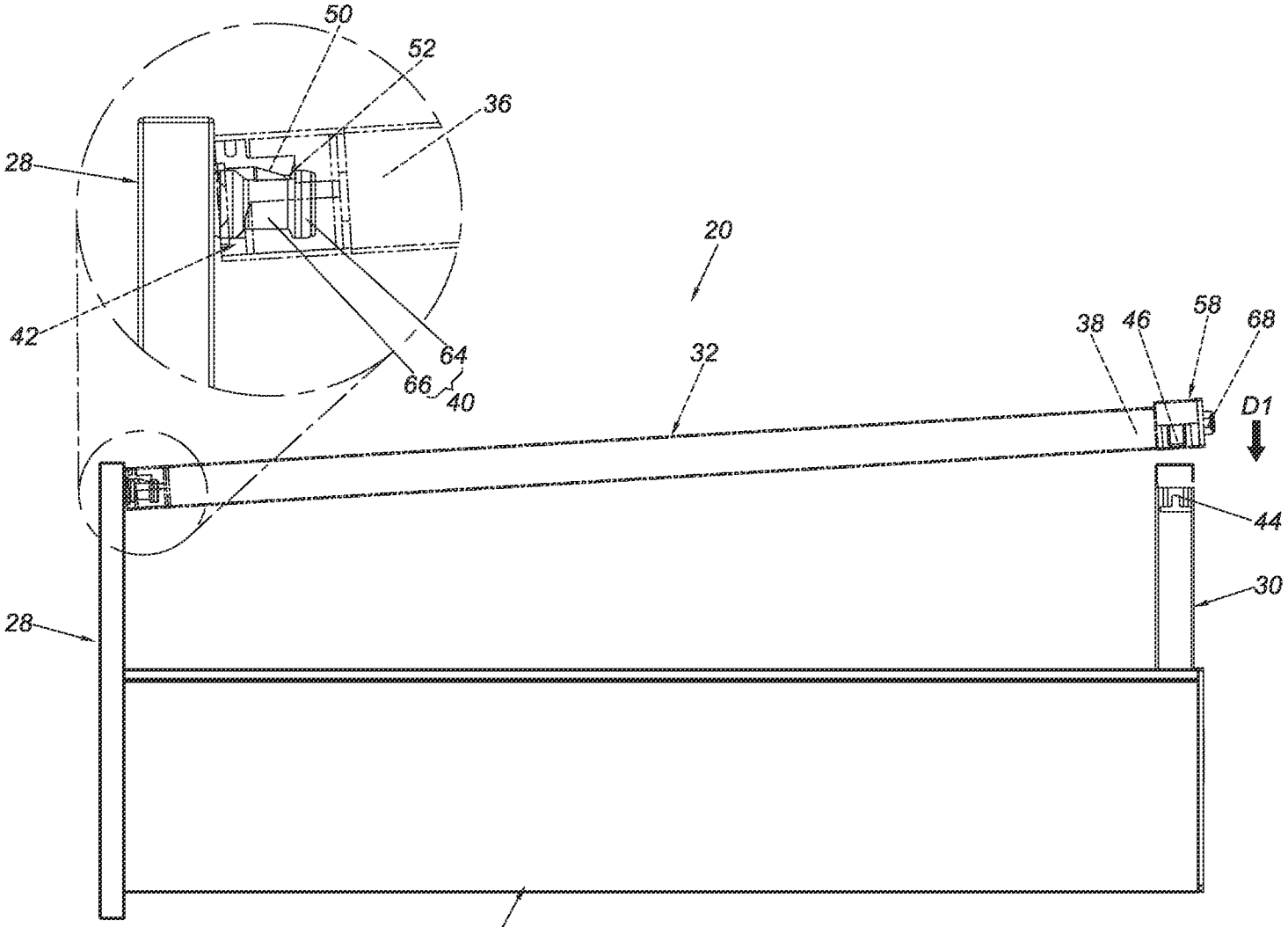
FIG. 7 is a diagram showing a third process of mounting the fitting member to the first panel and the second panel according to the embodiment of the present invention.
Figure 8:
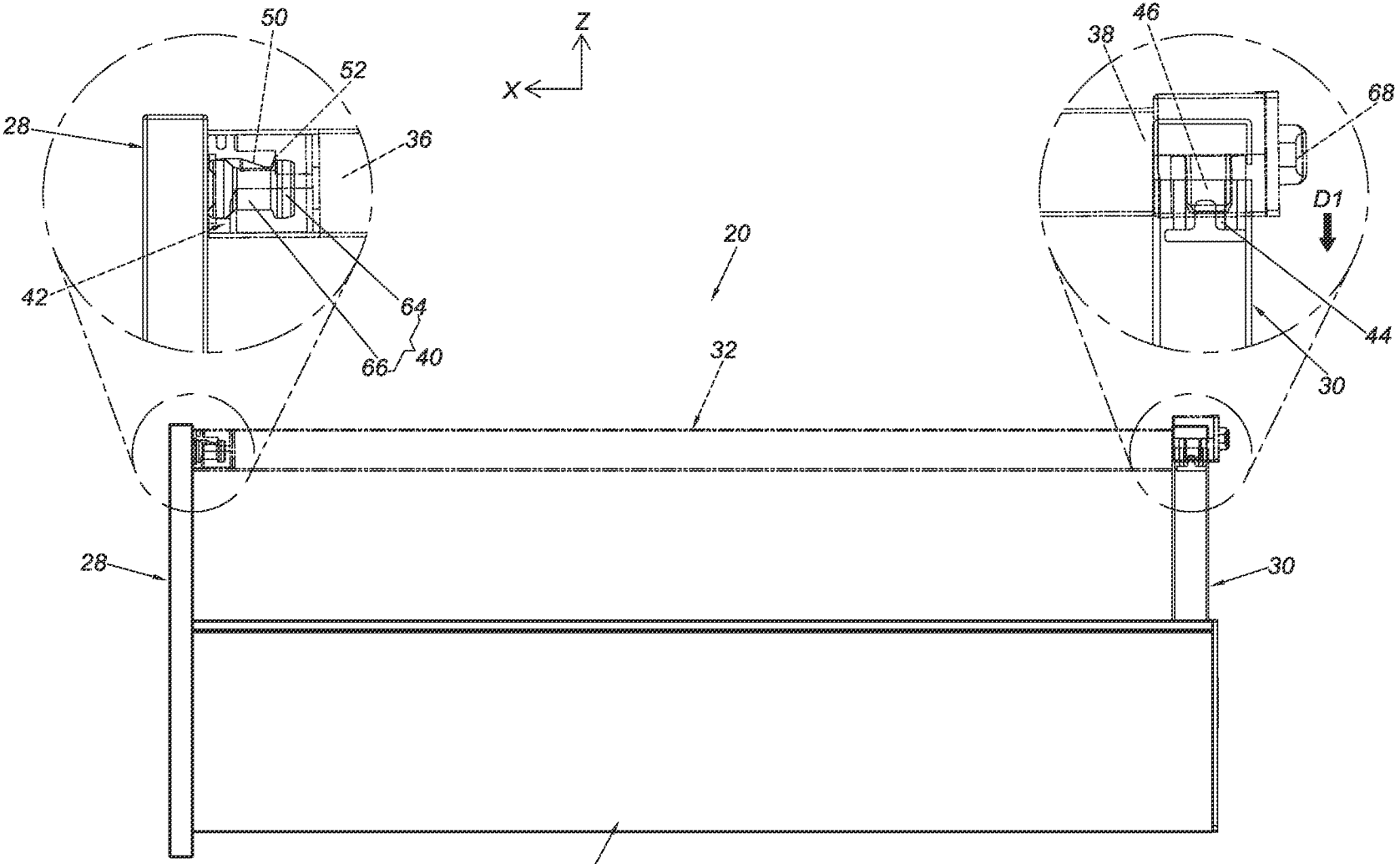
FIG. 8 is a diagram showing the fitting member being completely mounted to the first panel and the second panel according to the embodiment of the present invention.

As shown in FIG. 5 to FIG. 8, during a process of the first fitting member 32 being mounted to the first panel 28 and the second panel 30, the space 48 is configured to allow the head part 64 (and the extension part 66) of the first connecting feature 40 to enter therein (as shown in FIG. 5), and the guiding section 50 is configured to guide the head part 64 (as shown in FIG. 6) of the first connecting feature 40 to be engaged with the engaging section 52 (as shown in FIG. 7), such that the first fitting member 32 is detachably connected to the first panel 28. In addition, a user can press the second part 38 (such as the rear part) of the first fitting member 32 along a first predetermined direction D1 (such as a top-down direction shown in FIG. 7 and FIG. 8), in order to mount the second engaging structure 46 of the first fitting member 32 to the first engaging structure 44 of the second panel 30.

Figure 10:
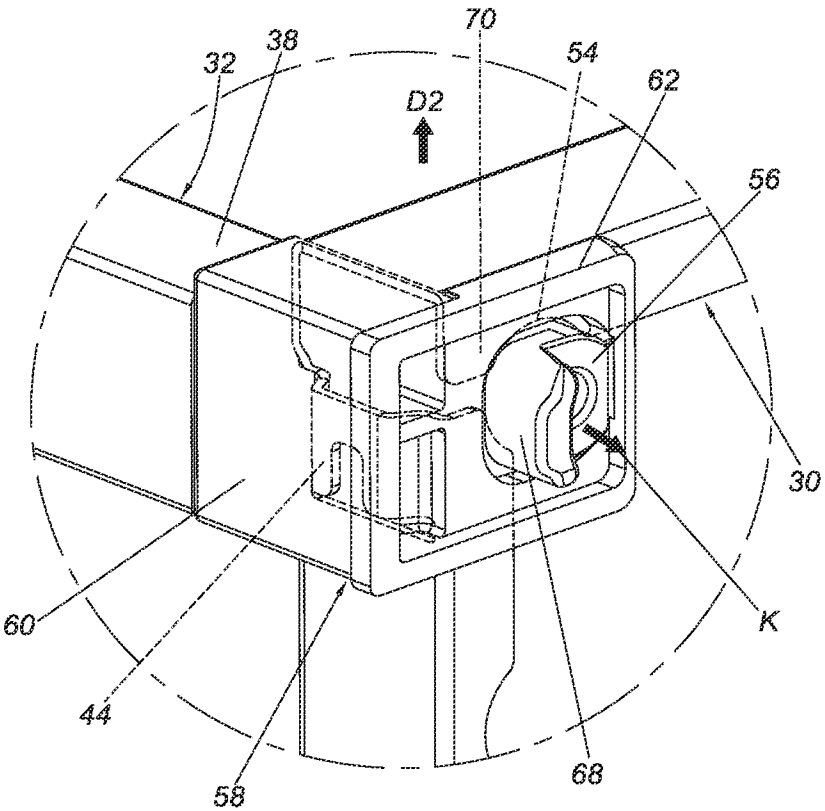
FIG. 10 is a partial view of the fitting member being completely mounted to the second panel according to the embodiment of the present invention.
Figure 9:
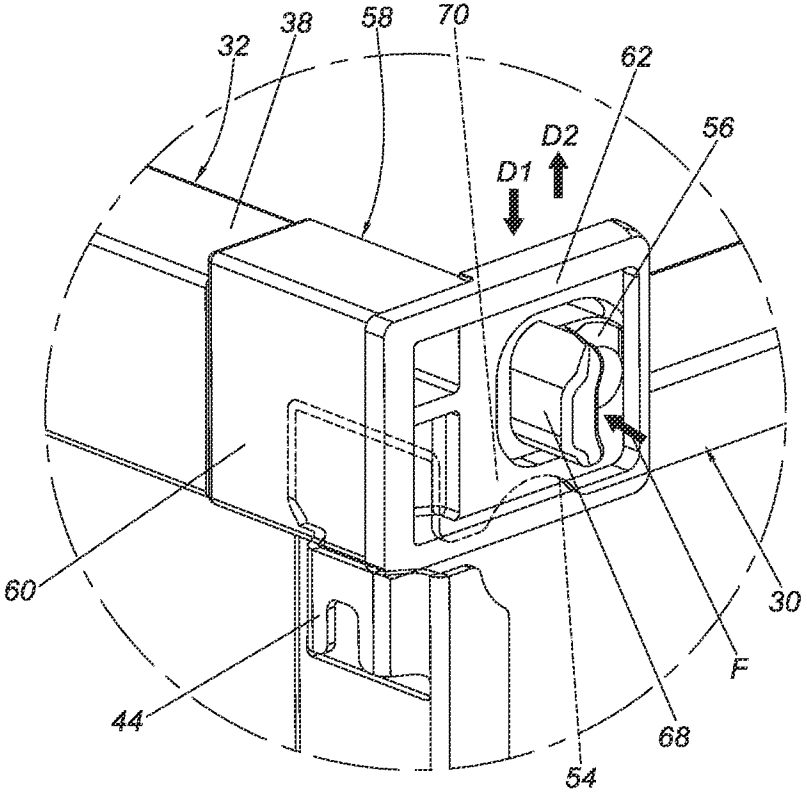
FIG. 9 is a partial view of the fitting member not being completely mounted to the second panel according to the embodiment of the present invention.

As shown FIG. 9 and FIG. 10, in the present embodiment, the first mounting feature 54 of the second panel 30 is a predetermined wall having a predetermined shape or outline, and the second mounting feature 56 of the first fitting member 32 is an elastic element (or elastic arm). In other alternative embodiment, the first mounting feature 54 can be an elastic element (or elastic arm), and the second mounting feature 56 can be a predetermined wall, but the present invention is not limited thereto.

Preferably, during a process of the second part 38 of the first fitting member 32 being mounted to the second panel 30 along the first predetermined direction D1, the second mounting feature 56 contacts a wall surface 70 of the second panel 30 to accumulate an elastic force F (as shown in FIG. 9). When the first fitting member 32 is located at a mounting position (as shown in FIG. 10), the second mounting feature 56 releases the elastic force F, such that the second mounting feature 56 is blocked by the first mounting feature 54 to prevent the first fitting member 32 from being detached from the second panel 30 along a second predetermined direction D2 opposite to the first predetermined direction D1. As such, the first fitting member 32 is mounted to the second panel 30 (as shown in FIG. 10).

Preferably, the first fitting member 32 further comprises an operating part 68 connected to the second mounting feature 56. When the user is going to detach the first fitting member 32 from the second panel 30 and the first panel 28, the user can apply an operating force K to the operating part 68 in a direction opposite to a direction of the elastic force F (as shown in FIG. 10), in order to drive the second mounting feature 56 to move, such that the second mounting feature 56 is no longer blocked by the first mounting feature 56, in order to allow the second part 38 (such as the rear part) of the first fitting member 32 to be lifted along the second predetermined direction D2 and detached from the second panel 30 (as shown in FIG. 9). As such, the first fitting member 32 can be detached from the second panel 30. Thereafter, the second connecting feature 42 of the first part 36 (such as the front part) of the first fitting member 32 can be detached from the first connecting feature 40 of the first panel 28. For example, the head part 64 of the first connecting feature 40 is detach from the engaging section 52 of the second connecting feature 42, such that the first fitting member 32 can be detached from the first panel 28 (please also refer to FIG. 5).

Therefore, the furniture system and the furniture assembly according to the embodiments of the present invention has the following technical features:

1. The first fitting member 32 and the first panel 28 are detachably connected to each other through the first connecting feature 40 and the second connecting feature 42. One of the first connecting feature 40 and the second connecting feature 42 is formed with a space 48, and a guiding section and an engaging section 52 are arranged in the space 48. Therefore, after entering the space 48, the head part 64 of the other one of the first connecting feature 40 and the second connecting feature 42 can be guided by the guiding section 50 to be engaged with the engaging section 52. Compared with the prior art that requires a spring or an actuator, the detachable connection design between the first fitting member 32 and the first panel 28 has simpler structural configuration, and can meet diverse requirements of the market.
2. When the user is going to detach the first fitting member 32 from the first panel 28 and the second panel 30, the user can first detach the first fitting member 32 from the second panel 30, and then further detach the first fitting member 32 from the first panel 28. Such configuration is convenient for the user. For example, after detaching the first fitting member 32 from the second panel 30, the head part 64 of the first connecting feature 40 is allowed to be detached from the engaging section 52 of the second connecting feature 42 accordingly, such that the first fitting member 32 can be detached from the first panel 28.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A furniture assembly, comprising:

a first panel arranged with a first connecting feature; and a fitting member arranged with a second connecting feature configured to be detachably connected with the first connecting feature;

wherein one of the first connecting feature and the second connecting feature is formed with a space, and a guiding section and an engaging section adjacent to the guiding section are arranged in the space, the other one of the first connecting feature and the second connecting feature comprises a head part;

wherein during a process of the fitting member being mounted to the first panel, the space is configured to allow the head part to enter therein, and the guiding section is configured to guide the head part to be engaged with the engaging section, in order to detachably connect the fitting member to the first panel;

wherein the fitting member comprises a first part, and the second connecting feature is located adjacent to the first part;

wherein the furniture assembly further comprises a second panel located at a rear side of the first panel, wherein the second panel is arranged with a first engaging structure, the fitting member further comprises a second part opposite to the first part, the fitting member is further arranged with a second engaging structure adjacent to the second part, and the second engaging structure is configured to be moved downward relative to the second panel to be inserted into the first engaging structure along a height direction of the furniture assembly;

wherein the second panel further comprises a first mounting feature, and the fitting member is further arranged with a second mounting feature configured to be detachably connected with the first mounting feature;

wherein during a process of the second part of the fitting member being moved downward relative to the second panel to be mounted to the second panel along the height direction of the furniture assembly, the second mounting feature is configured to contact a rear outer wall surface of the second panel to accumulate an elastic force; wherein when the fitting member is located at a mounting position, the second mounting feature is configured to release the elastic force, such that the second mounting feature is located below the first mounting feature to be blocked by the first mounting feature in order to prevent the second part of the fitting member from being moved upward relative to the second panel to be detached from the second panel along the height direction of the furniture assembly.

2. The furniture assembly of claim 1, wherein the fitting member is a rod.

3. The furniture assembly of claim 1, wherein the guiding section has an inclined surface or an arc surface.

4. The furniture assembly of claim 1, wherein the fitting member is further arranged with an auxiliary member adjacent to the second part, the auxiliary member comprises a first auxiliary part and a second auxiliary part bent relative to the first auxiliary part, wherein the first auxiliary part and the second auxiliary part are substantially perpendicularly connected to each other, wherein the second engaging structure is arranged on the first auxiliary part of the auxiliary member, and the second mounting feature is arranged on the second auxiliary part of the auxiliary member.

5. A furniture system, comprising:

a bottom plate;

a first side wall and a second side wall arranged at left and right sides of the bottom plate respectively;

a first panel and a second panel arranged at front and rear sides of the bottom plate respectively, wherein the first panel is arranged with a first connecting feature; and a fitting member comprising a first part and a second part, wherein the fitting member is arranged with a second connecting feature located adjacent to the first part, the second connecting feature is configured to be detachably connected with the first connecting feature, one of the first connecting feature and the second connecting feature is formed with a space, and a guiding section and an engaging section adjacent to the guiding section are arranged in the space, the other one of the first connecting feature and the second connecting feature comprises a head part;

wherein during a process of the fitting member being mounted to the first panel, the space is configured to allow the head part to enter therein, and the guiding section is configured to guide the head part to be engaged with the engaging section;

wherein the second panel comprises a first mounting feature, the fitting member is further arranged with a second mounting feature configured to be detachably connected with the first mounting feature, and one of the first mounting feature and the second mounting feature is an elastic element;

wherein the second panel is arranged with a first engaging structure, the fitting member is further arranged with a second engaging structure adjacent to the second part, and the second engaging structure is configured to be moved downward relative to the second panel to be inserted into the first engaging structure along a height direction of the furniture system;

wherein during a process of the second part of the fitting member being moved downward relative to the second panel to be mounted to the second panel along the height direction of the furniture system, the second mounting feature is configured to contact a rear outer wall surface of the second panel to accumulate an elastic force; wherein when the fitting member is located at a mounting position, the second mounting feature is configured to release the elastic force, such that the second mounting feature is located below the first mounting feature to be blocked by the first mounting feature in order to prevent the second part of the fitting member from being moved upward relative to the second panel to be detached from the second panel along a height direction of the furniture system.

6. The furniture system of claim 5, wherein the fitting member is a rod.

7. The furniture system of claim 5, wherein the guiding section has an inclined surface or an arc surface.

8. The furniture system of claim 5, wherein the fitting member is further arranged with an auxiliary member adjacent to the second part, the auxiliary member comprises a first auxiliary part and a second auxiliary part bent relative to the first auxiliary part, wherein the first auxiliary part and the second auxiliary part are substantially perpendicularly connected to each other, wherein the second engaging structure is arranged on the first auxiliary part of the auxiliary member, and the second mounting feature is arranged on the second auxiliary part of the auxiliary member.

* * * * *